United States Patent [19]

Kinner

[11] Patent Number: 4,766,702

[45] Date of Patent: Aug. 30, 1988

[54] DISK BRAKE GRINDER

[76] Inventor: James Kinner, 1620 Sixteenth Ave., San Francisco, Calif. 94122

[21] Appl. No.: 943,922

[22] Filed: Dec. 18, 1986

Related U.S. Application Data

[63] Continuation-in-part of Ser. No. 758,794, Jul. 25, 1985, abandoned.

[51] Int. Cl.[4] ..... B24B 1/00; B24B 7/00

[52] U.S. Cl. ..... 51/281 SF; 51/132; 51/131.3; 51/DIG. 3; 51/106 R

[58] Field of Search ..... 51/132, 281 SF, DIG. 3, 51/131.3, 129, 131.1, 131.4, 117, 118, 165.9, 165.81, 106 R; 157/14

[56] References Cited

U.S. PATENT DOCUMENTS

| | | | |
|---|---|---|---|
| 2,783,830 | 3/1957 | Pozerycki et al. | 157/14 X |
| 3,407,543 | 10/1968 | Gebel | 51/165.9 |
| 3,500,589 | 3/1970 | Ellege | 51/132 |
| 4,140,032 | 2/1979 | Besenbruch et al. | 51/106 R X |
| 4,525,957 | 7/1985 | Daniels | 51/131.1 |

*Primary Examiner*—Debra Meislin

*Attorney, Agent, or Firm*—Thomas M. Freiburger

[57] ABSTRACT

A method and apparatus for surfacing the opposed faces of brake disks achieves a surface pattern which promotes proper wearing-in of the disk and brake shoes or pads. The abrasive surface of a rotating abrading wheel applied to a brake disk rotating in the same angular direction as that of the abrading wheel. A rotating cup-shaped abrading wheel is tilted slightly with respect to the brake surface so that only one portion of the wheel engages the disk at a time resulting in a resurface pattern of lines that essentially do not cross over each other.

8 Claims, 3 Drawing Sheets

DISK BRAKE GRINDER

BACKGROUND OF THE INVENTION

This is a continuation-in-part of my copending application Ser. No. 758,794, filed July 25, 1985, now abandoned.

This invention relates generally to machines for resurfacing the opposed faces of a disk-shaped workpiece, and in particular relates to a novel machine for refinishing brake disks to achieve a desired pattern.

Disk brakes are widely used on motor vehicles, particularly on automobiles and on motorcycles. Generally such brakes have a disk attached to the vehicle wheel to be braked, and brake pads, or "shoes," which, when braking is desired, approach the opposing faces of the disk and slow the wheel through friction. The brake shoes usually have linings of asbestos or other high-friction material, whereas the disk itself is usually of metal so as to dissipate the heat of friction rapidly and remain sturdy during operation.

In order to achieve proper braking action, it is desirable that the faces of the disks be parallel and smooth. However, long or hard use of the brakes tends to roughen or groove these faces. Furthermore, rust and contamination may develop with time. Accordingly, refinishing of the brake disks is often necessary.

Refinishing of brake disks is normally done on a lathe. U.S. Pat. No. 3,456,401 to Kushmuk, for example, shows a brake disk resurfacing apparatus which is used as an attachment to a lathe. U.S. Pat. No. 3,500,589 to Ellege, which shows a two-step resurfacing process, similarly discloses use of a lathe. Other resurfacing methods are also disclosed in the art: U.S. Pat. No. 3,619,952 to Leming et al., for example, shows the use of resilient finishing disks after turning. Additionally, U.S. Pat. Nos. 4,361,988 to Scharfen and 3,548,549 to Dunn discloses the use of opposed cutting members and opposed grinders, respectively. These prior designs all necessitate the use of large machine tools, in most cases brake lathes, which are quite expensive and are furthermore fairly difficult and unwieldy to use as well as difficult to assemble and disassemble. Finally, disks resurfaced by prior art methods, which have a concentric pattern of resultant machined "lines," in a "phonograph" pattern, tend to wear unevenly and display a tendency to glaze.

This invention is directed to a new machine for refinishing brake disks, and is designed to be a significant improvement over the prior art. The apparatus of the invention is firstly relatively compact. Additionally, the apparatus is fairly simple to assemble and disassemble, as it is comprised of relatively simple component parts; thus, it can be manufactured quite economically. Disks refinished by the method of the present invention have a substantially reduced tendency to wear unevenly, and are provided with greatly improved surface pattern and parallelism. In addition, brake pad seating ability and parallelism of the disk surface, according to testing done by the inventor of the instant invention, is substantially improved and there is thus less of a tendency to develop wave patterns that are inherent in disks resurfaced by prior art methods which have concentric patterns. Disks resurfaced by the prior art methods display a surface pattern that is conductive to galling and glazing; thus, with the new method, disks may be resurfaced far less frequently.

SUMMARY OF THE INVENTION

Accordingly, it is an object of the present invention to provide a method of grinding brake disks which produces brake disks having greatly improved surface pattern and parallelism, thus obviating the need for frequent resurfacing.

It is yet another object of the present invention to provide an apparatus for grinding disk brakes which resurfaces brake disks in such a way as to provide greater parallelism and surface consistency, with a resurfacing pattern of fine lines which are not concentric with the disk, but generally radial.

It is still a further object of the present invention to provide a relatively compact apparatus for grinding disk brakes, which apparatus is comprised of relatively simple component parts, is fairly easy to assemble and disassemble, and is relatively inexpensive to manufacture.

Further objects and advantages of the invention will become apparent from the study of the following description and attached drawings.

In one aspect of the present invention, an abrading wheel is applied to the rotating surface of a brake disk. The disk is caused to rotate by means of a drive shaft which supports the disk and extends perpendicularly through its axis of rotation. Disk rotation speed may be adjusted by means of a potentiometer.

In another aspect of the present invention, the abrading wheel is caused to rotate in an angular direction the same as that of the rotating disk. Coarse and fine adjustment mechanisms are included in order to direct the movement of the rotating wheel. In a preferred embodiment of the invention, the adjustment mechanisms comprise an interlocking worm gear.

The rotating cup-shaped abrading wheel is tilted slightly with respect to the brake disk surface, so that only one portion of the wheel engages the disk at a time.

DESCRIPTION OF PREFERRED EMBODIMENT

Figure 1:
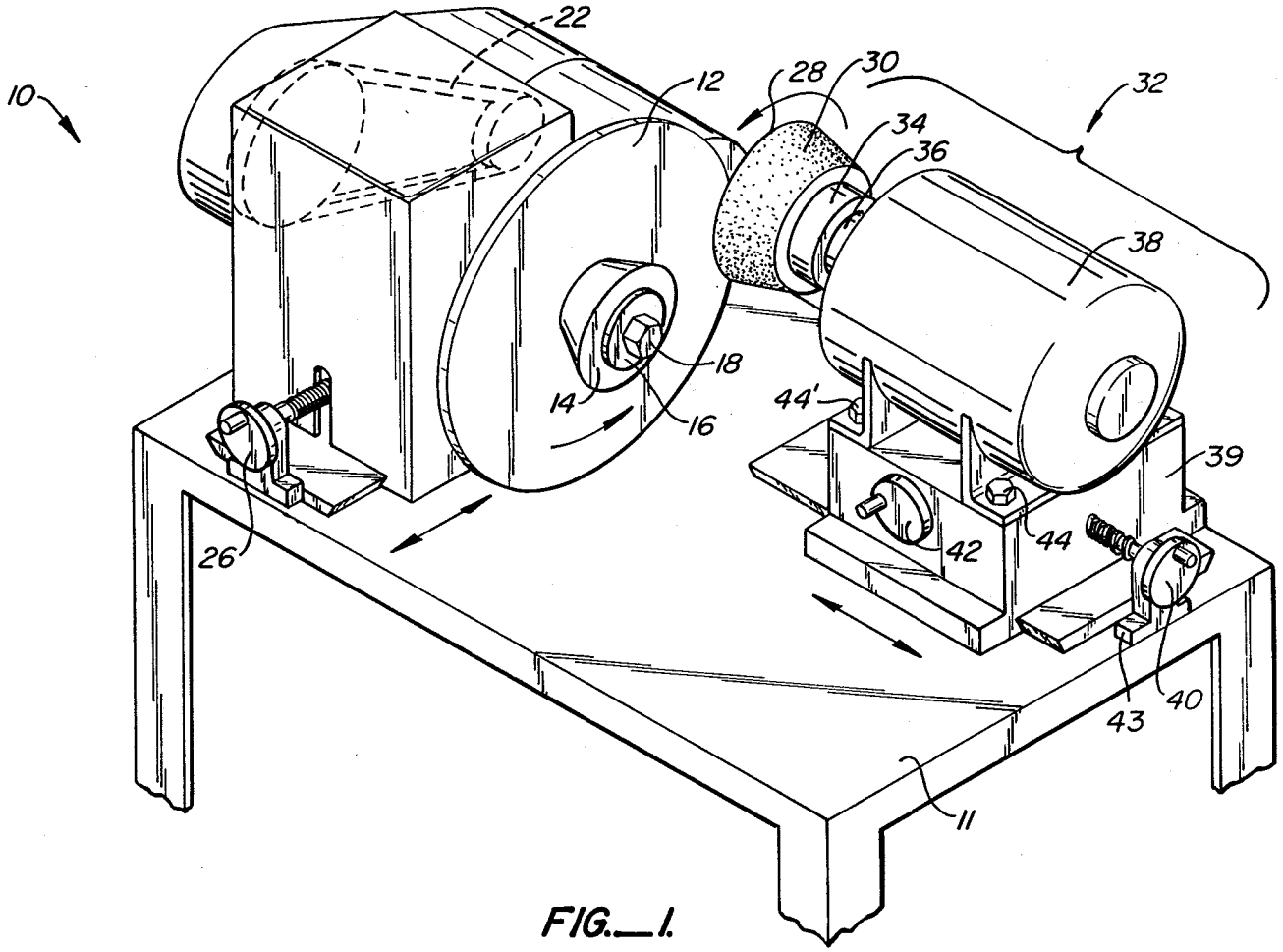
FIG. 1 is a perspective view of the brake disk grinder of the invention.

In FIG. 1, the brake disk grinder is shown generally at 10, which is preferably mounted on a level surface such as table 11. A brake disk 12 is shown mounted and held in place by means of a centering device 14, a washer 16, and a centering bolt 18. The disk 12 is caused to rotate about its axis of rotation by means of a drive belt 22. When no longer in operation, the linear position of the disk may be adjusted by means of a disk adjustment knob 26 operatively connected to a drive shaft 20 (see FIG. 2). When in operation, the abrasive surface 28 of an abrading wheel 30 is caused to contact the disk 12, thereby smoothing the disk and producing a ground pattern of lines 31 generally in the form of curving grooves extending outwardly from the center of the disk toward the disk perimeter (see FIGS. 5 and 6). This pattern, in contrast to the pattern of concentric circles produced by the machining methods of the prior art, contributes to the surprising improvement in results achieved by the present invention.

Part of abrading wheel assembly 6 shown generally at 32, the abrading wheel 30 extends toward the disk 12 from the motor 38. The abrading wheel is preferably of the cup-shaped type as shown in the drawings. The wheel is rotated, preferably in an angular direction the same as that of the disk 12 as shown by arrows in FIG. 1. Superior results are achieved when the rotation speed of the disk 12 is at least approximately 400 rpm, and that of the abrading wheel at least about 3450 rpm. The abrading wheel 30 is rotated by means of the motor 38, and is operatively connected to the abrading wheel assembly shaft 36. The abrading wheel assembly 32 is mounted to the table 11 by means of bolts 44 and 44'. The position of the abrading wheel relative to the disk 12 may be adjusted by means of a coarse adjustment knob 40 and a fine adjustment knob 42.

Figure 2:
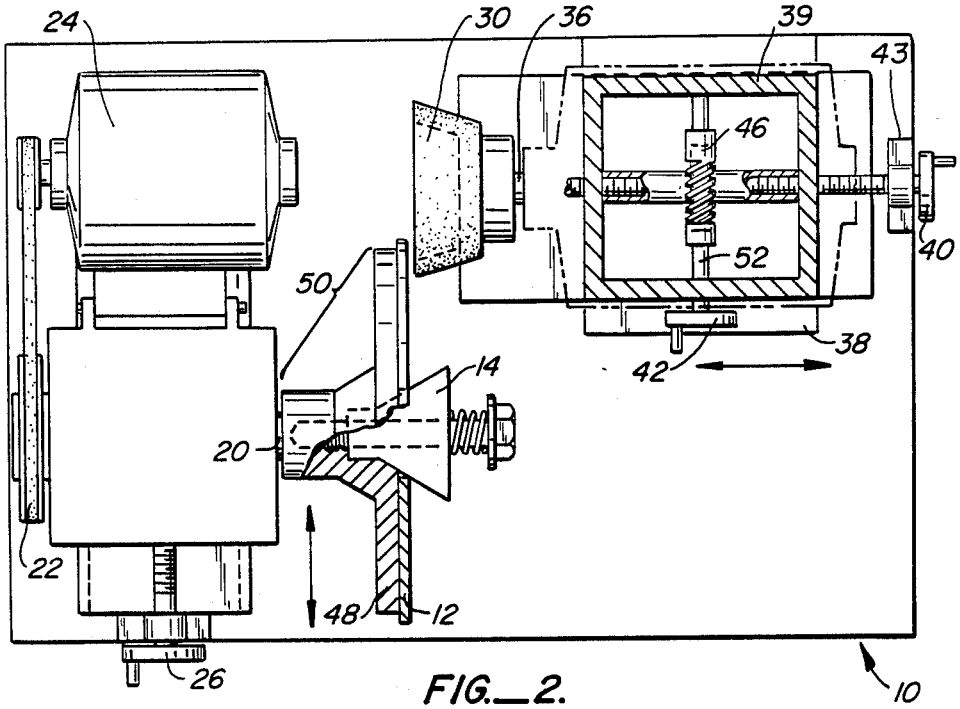
FIG. 2 is a partially cut away top plan view of the brake disk grinder.
Figure 3:
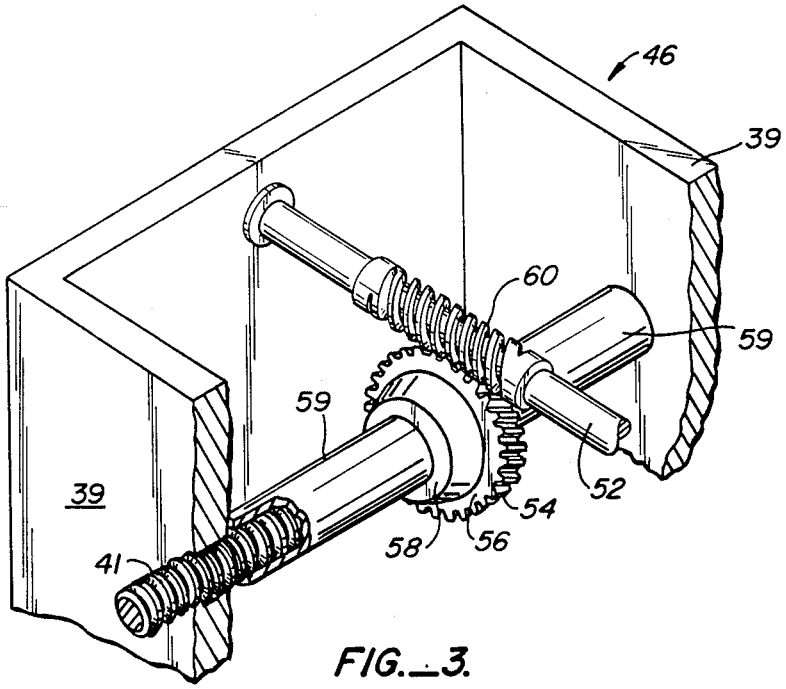
FIG. 3 is a cut away view of the abrading wheel adjustment mechanism.

The brake disk grinder is shown in somewhat more detail in FIGS. 2 and 3. In FIG. 2 the mounting assembly is seen in a partially cut away view. The disk 12 is held in place on the drive shaft 20 by means of a tapered, generally conical centering device 14, engaged against an opening in the disk by a bolt 15 and spring 17. The spindle and drive plate assembly 50 is caused to rotate by means of a drive belt 22 driven by the motor 24.

The operational mechanism of the coarse adjustment knob 40 and the fine adjustment knob 42 may be seen in FIG. 2 and in somewhat more detail in FIG. 3. As may be seen, coarse and fine adjustment of the positioning of abrading wheel 30 relative to the disk 12 is effected by means of a worn gear arrangement shown generally at 46. The worm gear arrangement operates by means of evenly spaced teeth 54 on a worm gear 56 on a coarse adjustment shaft 41 by means of an adapter 58, the teeth interlocking one-for-one with threads 60 of a worm or screw on a fine adjustment shaft 52.

As can be clearly seen from FIGS. 2 and 3, the coarse and fine adjustments operate as follows: The coarse adjustment knob 40 and shaft 41 are rotated to shift the position of the housing 38 via a base 39. The knob 40 and shaft 41 rotate but do not move axially because they are held against axial movement by a bracket 43 as shown in FIG. 1. Movement of the base 39 is effected by threaded engagement between the threaded shaft 41 and internal threads of the worm gear of adapter 58 (if it is fixed to the worm gear). Rotation of the shaft therefore causes the worm gear to move axially while remaining non-rotational, and this motion is transferred to the base 39 by free-floating spacer sleeves 59 positioned somewhat loosely over the shaft 41 as shown. Rotation of the shaft 41 therefore causes movement of the base axially with respect to the shaft 41, in a coarse adjustment mode. However, if the fine adjustment knob 42 and shaft 52 and worm threads 60 are rotated, the worm gear 56 will rotate very slowly, advancing along the now stationary threads of the coarse adjustment shaft 41 and causing the base 39 to advance very slowly, axially with respect to the shaft 41 and the bracket 43.

Figure 4:
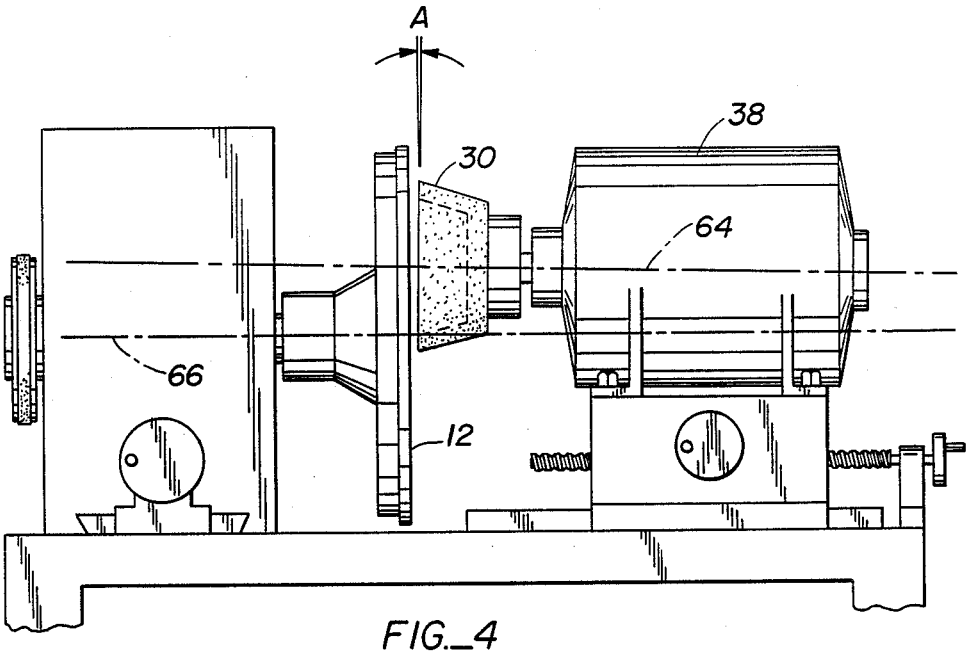
FIG. 4 is a side elevation view illustrating the slight tilt of the abrading wheel with respect to the brake disk.
Figure 5:
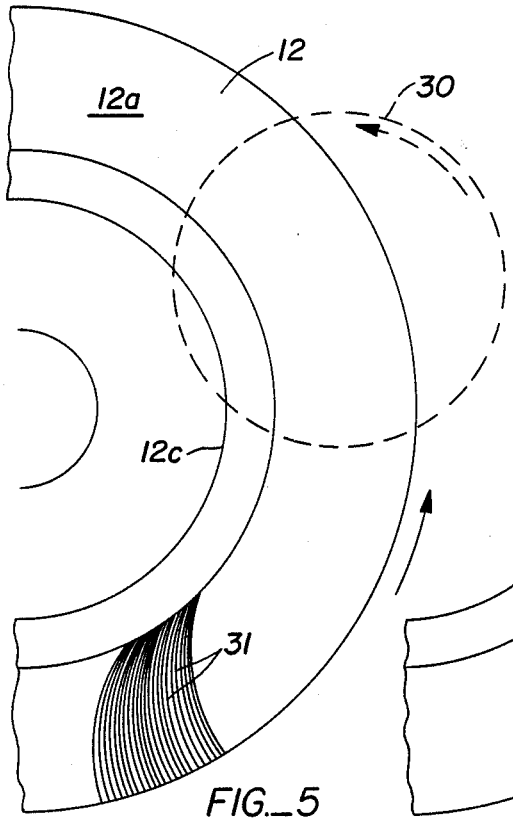
FIG. 5 is a fragmented frontal view of one surface of a disk, showing the surface pattern achieved by the machine and method of the invention.
Figure 6:
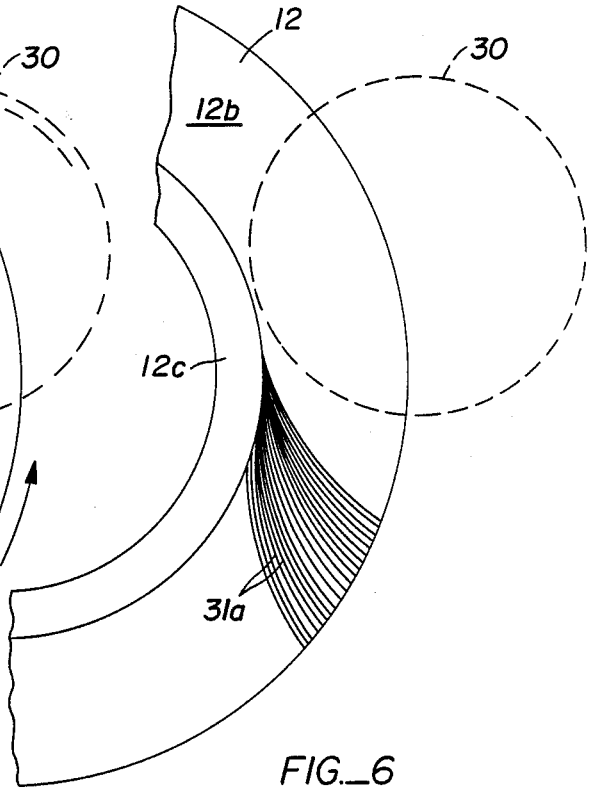
FIG. 6 is a frontal view of the opposite surface of the disk, showing the resurfacing pattern on that side.

FIGS. 4, 5 and 6 illustrate the system and method of the invention for achieving a resurface pattern which is highly effective in promoting proper wearing-in of the disk and the brake shoes which engage it.

As shown in FIG. 4, the abrading wheel 30 is on an axis of rotation 64 which is slightly tilted from parallelism with an axis of rotation 66 of the brake disk and its rotating assembly. The two axes are at a small angle A from each other, which may be about 1°. This assures that only one section of the cup-shaped abrading wheel's face will contact the disk 12, to produce the surface grinding patterns 31 and **31*a* shown in FIGS. 5 and 6. In the arrangement shown, generally the lower area of the face of the abrading wheel 30** contacts the disk, while the upper area of the face remains spaced from the disk.

FIG. 5 shows in dashed lines the general position of the abrading wheel 30 as it engages the flat face **12*a* of a disk 12, as the disk is shown positioned in FIG. 4. The grinding wheel 30, when engaging this unobstructed disk face 12*a*, preferably generally straddles the annular braking area of the face 12*a* as shown in FIG. 5. Only the lower edge or portion of the wheel 30 engages the disk face 12*a*, but because both the wheel 30 and the disk 12 are rotating, in the direction indicated, a surface pattern of curving lines 31 is generated. The curving lines 31 are not truly arcuate, but each is of varying radius generally as shown. The lines 31 are generally transverse to the circumference of the disk and to the path of engagement of the brake pads with the face 12*a*. Thus, the lines 31** are "generally radial", with respect to the general direction in which they sweep across the brake shoes.

FIG. 6 shows the position of the abrading wheel 30 on the opposite side of the disk 12, engaging the braking surface area **12*b*. On this side of the brake disk is a hub 12*c*, schematically indicated in FIG. 6. The hub prevents the abrading wheel 30 from moving any closer to the center of the disk 12. The resulting resurfaced pattern of lines 31*a* is shown generally in FIG. 6**. Again, the surface lines are generally radial as engaged by the brake pads, actually comprising a complex curve of varying radius.

The above described preferred embodiment is intended to illustrate the principles of the invention, but not to limit its scope. Other embodiments and variations to this preferred embodiment will be apparent to those skilled in the art and may be made without departing from the scope of the invention as defined in the following claims.

I claim:

1. A method of grinding and resurfacing brake disks having two opposed faces each with annular braking areas and having a central hub area with at least one opening, and for producing on the braking areas a desirable surface pattern of curving lines generally transverse to the circumference of the disk, comprising:

securing the brake disk to a shaft via an opening in the hub area of the disk, the shaft extending from a first housing secured to a table;

providing a motor-driven cup-shaped abrading wheel on a base connected to the table, with a rotational axis generally parallel to the shaft holding the disk, and with position adjustment means in association with the base for advancing the abrading wheel substantially axially forward toward the brake disk in position to contact the braking area of the disk, the abrading wheel being on a rotational axis which is slightly tilted with respect to the shaft with the brake disk, so that only a portion of the abrading wheel in a single arc contacts the brake disk at one time and being positioned so that only a portion of the wheel's abrasive surface overlaps the face of the brake disk;

rotating the shaft with the brake disk at a first predetermined speed at least about 400 rpm, and rotating the abrading wheel at a second predetermined speed at least about 3450 rpm;

advancing the abrading wheel toward and into contact with the braking area of a face of the brake disk, using the position adjustment means such that the single arc of contact of the tilted abrading wheel on the disk extends substantially only from the periphery of said central hub area to the outer edge of the brake disk, until the braking area is rendered substantially smooth and there is produced a desirable surface pattern comprising curving lines non-concentric with the disk and positioned generally radially on the disk essentially without crossing over each other, for promoting proper brake wear.

2. The method of claim 1, wherein the brake disk and the abrading wheel are rotated in the same direction.

3. The method of claim 1, further including providing means for varying the speed of rotation of the brake disk.

4. The method of claim 1, wherein the position adjustment means includes a coarse adjustment means and a fine adjustment means.

5. The method of claim 4, wherein the coarse and fine adjustments comprise a screw-threaded coarse adjustment shaft generally parallel to the axis of the abrading wheel and journalled for rotation in the base, a retaining bracket secured to the table and preventing axial movement of the coarse adjustment shaft while permitting rotation thereof, a coarse adjustment knob secured to the end of the coarse adjustment shaft for manual rotation thereof, a worm gear member coaxial with and in threaded engagement on the coarse adjustment shaft, spacer sleeves slidable over the coarse adjustment shaft, positioned to engage the base and to hold the worm gear member against axial movement with respect to the base and to transfer axial force from the worm gear member to the base to shift the position of the base axially with respect to the coarse adjustment shaft in response to manual rotation of the shaft, a fine adjustment shaft journalled for rotation in the base and perpendicular to the coarse adjustment shaft, a fine adjustment knob on the end of the fine adjustment shaft, and a worm fixed on the fine adjustment shaft and in engagement with the worm gear, whereby manual rotation of the fine adjustment shaft will effect very slow rotation of the worm gear while the coarse adjustment shaft remains non-rotational, causing the worm gear to advance very slowly along the coarse adjustment shaft and effecting fine adjustment movement of the base.

6. An apparatus for surfacing a face of a brake disk having two opposed faces and a central hub area with a central hole, and for generating a desired surface pattern on the face of the disk, comprising:

a table;

means for supporting the disk generally from its center, said supporting means being secured to the table;

means for causing the disk to rotate in a first angular direction, including a first driven shaft having an axis about which the disk rotates, said supporting means comprising a support plate secured to the first driven shaft and means for securing the brake disk against the support plate by engaging the central hole in the disk;

a cup-shaped abrading wheel having an abrasive surface;

abrading adjustment means for adjusting the axial position of the abrading wheel, including a coarse adjustment means and a fine adjustment means, for engaging the abrading wheel against the disk face and for controlling the depth to which the disk face is abraded;

base means for supporting the abrading wheel such that the abrasive surface is slightly tilted with respect to the disk face, said base mans including a second shaft supporting said abrasive wheel, said second shaft being slightly tilted with respect to and offset from the first shaft such that the abrading wheel makes a single arc of contact with the disk face, said single arc of contact extending substantially only from the periphery of said central hub area to the outer edge of the brake disk;

motor means for driving the abrading wheel on an axis of the second shaft in the same angular direction as the rotation of the brake disk, and such that only a portion of the wheel's abrasive surface overlaps the face of the brake disk; and position adjustment means for relative radial shifting of the positions of the first shaft and the second shaft prior to engagement of the abrading wheel with the disk face, to accommodate brake disks of different sizes;

whereby there is formed on the disk face a surface pattern of curving lines not concentric with the disk and generally radially disposed on the disk and essentially not crossing over each other, for promoting proper brake wear.

7. The apparatus of claim 6, wherein said mans for securing the disk onto the support plate comprises a tapered centering member engaged through the central hole in the disk, and a threaded centering bolt engaged with the support plate further drawing the centering member against the hole in the disk to center the disk and hold it tightly against the support plate.

8. The apparatus of claim 6, wherein the coarse adjustment means and the fine adjustment means comprise a screw-threaded coarse adjustment shaft generally parallel to the axis of the abrading wheel and journalled for rotation in the base means, a retaining bracket secured to he table and preventing axial movement of the coarse adjustment shaft while permitting rotation thereof, a coarse adjustment knob secured to the end of the coarse adjustment shaft for manual rotation thereof, a worm gear member in threaded engagement on the coarse adjustment shaft, spacer sleeves slidable over the coarse adjustment shaft, position to engage the base means and to hold the worm gear member against axial movement with respect to the base means and to transfer axial forces from the worm gear member to the base means to shift the position of the base means axially with respect to the coarse adjustment shaft in response to manual rotation of the shaft, a fine adjustment shaft journalled for rotation in the base means and perpendicular to the coarse adjustment shaft, and a worm fixed on the fine adjustment shaft and in engagement with the worm gear, whereby manual rotation of the fine adjustment shaft will effect very slow rotation of the worm gear while the coarse adjustment shaft remains non-rotational, causing the worm gear to advance very slowly along the cloarse adjustment shaft and effecting fine adjustment movement of the base means.

* * * * *